United States Patent [19]

Fujita et al.

[11] Patent Number: 4,731,966

[45] Date of Patent: Mar. 22, 1988

[54] VIBRATION ENERGY ABSORBER DEVICE

[75] Inventors: Takafumi Fujita, 1-8-2-207, Saiwai-cho, Chiba-shi, Chiba-ken; Satoshi Fujita, Tokyo; Shigeru Fujimoto; Noboru Narikawa, both of Yokohama; Chiaki Tsuruya, Tokyo, all of Japan

[73] Assignees: Takafumi Fujita, Chiba; Kabushiki Kaisha Toshiba, Kawasaki; Oiles Industry Co., Ltd., Tokyo, all of Japan

[21] Appl. No.: 872,410

[22] Filed: Jun. 10, 1986

[30] Foreign Application Priority Data

| | | | |
|---|---|---|---|
| Dec. 27, 1985 | [JP] | Japan | 60-294019 |
| Dec. 27, 1985 | [JP] | Japan | 60-294020 |
| Jun. 19, 1986 | [JP] | Japan | 60-133434 |

[51] Int. Cl.[4] ..... E04H 9/02

[52] U.S. Cl. ..... 52/167; 52/573; 248/618; 248/622; 267/140.4

[58] Field of Search ..... 52/167, 383, 573; 14/16.1, 16.5; 248/583–586, 618, 619, 622, 632, 634, 636, 638; 384/36; 267/63 S, 140.5, 140.4, 141.3, 153; 188/378, 379

[56] References Cited

U.S. PATENT DOCUMENTS

| | | | |
|---|---|---|---|
| 3,245,646 | 4/1966 | Baratoff | 248/568 |
| 3,394,295 | 1/1986 | Koster et al. | 14/16.1 |
| 3,764,100 | 10/1973 | Young et al. | 267/141.3 |
| 4,117,637 | 10/1978 | Robinson | 52/167 |
| 4,188,681 | 2/1980 | Tada et al. | 14/16.1 |
| 4,328,648 | 5/1982 | Kalpins | 52/167 |
| 4,429,450 | 2/1984 | Reeve | 29/451 |
| 4,499,694 | 2/1985 | Buckle et al. | 52/167 |
| 4,593,502 | 1/1986 | Buckle | 52/167 |
| 4,599,834 | 1/1986 | Fujimoto et al. | 52/167 |

FOREIGN PATENT DOCUMENTS

| | | | |
|---|---|---|---|
| 1088693 | 9/1960 | Fed. Rep. of Germany | 52/167 |
| 1459949 | 1/1970 | Fed. Rep. of Germany | 52/167 |
| 2217768 | 10/1973 | Fed. Rep. of Germany | 52/167 |
| 2020830 | 7/1970 | France . | |
| 52549 | 5/1982 | France | 52/167 |
| 52-49609 | 4/1977 | Japan . | |
| 59-62742 | 4/1984 | Japan . | |
| 500363 | 1/1971 | Switzerland . | |
| 890672 | 3/1962 | United Kingdom . | |
| 723083 | 4/1980 | U.S.S.R. | 52/167 |
| 813020 | 3/1981 | U.S.S.R. | 267/140.4 |

OTHER PUBLICATIONS

S. P. Timoshenko et al., Vibration Problems in Engineering, 1974, pp. 144–153, 186–201, 238–241, 362–365, 516, 517, x–xiii & 2 front pages.

McGraw Hill, Dictionary of Scientific and Technical Terms, Third Edition, pp. 518, 519.

*Primary Examiner*—John E. Murtagh

*Assistant Examiner*—Andrew Joseph Rudy

*Attorney, Agent, or Firm*—Oblon, Fisher, Spivak, McClelland & Maier

[57] ABSTRACT

A vibration energy absorber device includes a first fixing member fixed to a building bottom wall, a second fixing member fixed to a building foundation, a lead elastoplastic member having elasticity, both ends of the elastoplastic member being firmly coupled to the corresponding fixing members, and reinforcing members embedded in the elastoplastic member. The reinforcing members include a plurality of first members of a metal (e.g., iron) having a higher tensile strength than that of the elastoplastic member. The first members are wire rods extending from one end to the other end of the elastoplatic member, and are disposed in the elastoplastic member at equal angular intervals.

11 Claims, 28 Drawing Figures

VIBRATION ENERGY ABSORBER DEVICE

BACKGROUND OF THE INVENTION

1. Field of the Invention

The present invention relates to a vibration energy absorber device for decreasing a vibration force acting on a construction, by absorbing vibration energy produced by an earthquake or the like, and for preventing the construction from being damaged or destroyed and, more particularly, to a device for absorbing vibration energy by utilizing plastic deformation of structural elements.

2. Discussion of Background

Conventional energy absorber devices of this type can be classified into three types, according to their energy absorption mechanisms. A conventional energy absorber device of a first type uses a fluid or viscoelastic material. When vibration energy acts on this material, it is converted to a viscous flow of the material, thereby absorbing the vibration energy. A conventional energy absorber device of a second type comprises overlying metal members. When vibration energy acts on these metal members, it is converted to a frictional force produced between the contact surfaces of the metal members and can thus be absorbed. A conventional energy absorber device of a third type comprises a plastically deformable member. When vibration energy acts on the member, the energy is absorbed by plastic deformation of the member.

Among these energy absorber devices, the device of the third type, i.e., the plastic deformation type for absorbing vibration energy by utilizing plastic deformation of the material, has a simpler structure as compared to the other energy absorber devices, and can be manufactured at low cost.

Typical examples of a conventional plastic deformation type vibration energy absorber are cyclic shear energy absorbers described in U.S. Pat. Nos. 4,117,637 and 4,499,694. Each prior art device comprises a pair of fixing members respectively fixed on the lower surface of the construction and the upper surface of the foundation, with an elastoplastic member being located between the fixing members. The ends of the elastoplastic member are coupled to the corresponding fixing members.

According to the conventional energy absorber having the elastoplastic member, if vibration energy produced by an earthquake or the like acts on the construction and both the fixing members are displaced, relative to each other, in the horizontal direction, the elastoplastic member is cyclically shear-deformed upon this relative displacement of the fixing members. That is, part of the vibration energy is consumed due to plasticity of the elastoplastic member. In other words, part of the vibration energy is absorbed by the elastoplastic member and therefore, vibration energy directly acting on the construction can be decreased. The construction can thus be effectively protected from the vibration energy produced by an earthquake or the like. When the elastoplastic member is cyclically shear-deformed, the diameters of both end portions of the elastoplastic member radially decrease; conversely, the diameter of the intermediate portion of the elastoplastic member, i.e., the axial central portion thereof radially increases. Since both ends of the elastoplastic member receive cyclic loads by this extension and contraction, they are subject to repeated extension and contraction deformations.

The extended ends of the elastoplastic member, however, cannot be restored to their original state, even after a compression force has acted thereon. For this reason, if the distance between the fixing members is constant, the end portions of the elastoplastic member must radially decrease in order to absorb the axial extentions of the end portions thereof and the material of elastoplastic member flow from the end portions to the axial central portion. As a result, the elastoplastic member is deformed as described above. Upon drawdown of the ends of the elastoplastic member, the resistance of the elastoplastic member against rupture is decreased, and hence, the vibration energy absorption capacity of the elastoplastic member is degraded. In the worst case, the elastoplastic member ruptures at the drawdown portion.

In order to solve the problem posed by the elastoplastic member itself, energy absorber devices having elastoplastic members and metal coils wound around respective elastoplastic members have been proposed in the above-mentioned official gazette. This coil allows plastic shear deformation of the elastoplastic member itself, and prevents the elastoplastic member from being radially contracted or expanded. When the elastoplastic member is shear-deformed, the coil must be deformed along with the elastoplastic member. However, since the coil is made of a continuous wire rod, a torsional force as well as a tension force acts on this wire rod. The coil then receives the torsional force as well as the restriction force (acting in a direction perpendicular to the longitudinal direction of the wire rod) for restricting radial deformation of the elastoplastic member. Therefore, the coil tends to be damaged. In order to prevent damage to the coil, the diameter of the wire rod of the coil can be increased, so as to improve the mechanical strength of the coil. However, since the rigidity of the coil itself is therefore increased, shear deformation of the elastoplastic member is restricted by the coil. Therefore, vibration energy cannot be effectively absorbed by the elastoplastic member.

In the energy absorber device described in U.S. Pat. No. 4,499,694, the elastoplastic member and the coil are housed in a rubber bearing for supporting the construction. It is therefore difficult to properly maintain the elastoplastic member and the coil. Since the vibration energy absorption capability is degraded upon repetition of shear deformation, the elastoplastic member must be periodically inspected and replaced if necessary. In addition, the coil must also be inspected for damage to the wire rod thereof. However, since the elastoplastic member and the coil are housed in the rubber bearing, inspection and replacement cannot be easily performed. In particular, the need for replacement of the elastoplastic member is often inaccurately judged.

SUMMARY OF THE INVENTION

The present invention has been made in consideration of the above situation, and has as its object to provide a vibration energy absorber device, wherein the vibration energy absorption capacity of an elastoplastic member can be maintained for a long period of time and, at the same time, the elastoplastic member can be easily inspected and replaced.

In order to achieve the above object of the present invention, there is provided a vibration energy absorber device located between two construction members, having opposite surfaces spaced apart from each other, for absorbing vibration energy causing a relative displacement of the construction members along a direction parallel thereto, comprising:

first and second fixing members, respectively mounted on the construction members such that at least the displacement of each fixing member relative to the corresponding construction member along the parallel direction is prevented;

an elastoplastic member which is located between the first and second fixing members, and ends of which are respectively coupled to the first and second fixing members, said elastoplastic member being subjected to plastic shear deformation; and reinforcing means embedded in the elastoplastic member so as to allow plastic shear deformation of the elastoplastic member, the reinforcing means including a plurality of first reinforcing members made of a material having a higher mechanical strength than that of the elastoplastic member, and the first reinforcing members being adapted to extend from one end to the other of the elastoplastic member, and being distributed along a peripheral portion of the elastoplastic member.

Since the first reinforcing members are embedded inside the elastoplastic member, in the vibration energy absorber device of the present invention, the drawdown and expansion deformation of the elastoplastic member can be effectively prevented, even if it receives cyclic shear deformation. More specifically, plastic deformation causing the drawdown of both ends of the elastoplastic member and plastic deformation radially expanding the axial central portion of the elastoplastic member can be effectively restricted by the first reinforcing members. With the device of the present invention, the elastoplastic member can be subjected to cyclic plastic shear deformation while maintaining its initial shape for a long period of time. The degradation of the energy absorption capacity of the elastoplastic member by the drawdown thereof can likewise be prevented. In addition, damage to the elastoplastic member (such as rupture) can also be prevented. Therefore, the elastoplastic member can be used for a long period of time.

Since the first reinforcing members are embedded in the elastoplastic member in the present invention, the elastoplastic member can be externally inspected without interference from the first reinforcing members, and the degree of fatigue of the elastoplastic member can be inspected by observing the outer surface thereof, etc. Therefore, the need for replacement of the elastoplastic member can be accurately judged.

The above and other objects, features and advantages of the present invention will be apparent from the following detailed description when taken in conjunction with the accompanying drawings.

DESCRIPTION OF THE PREFERRED EMBODIMENTS

Figure 1:
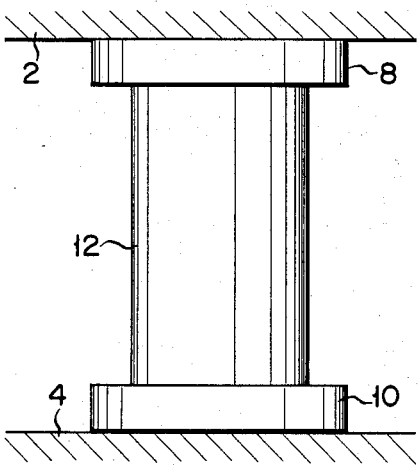
FIG. 1 is a front view showing a vibration energy absorber device according to a first embodiment of the present invention.

Referring to FIG. 1, a vibration energy absorber device of the present invention is illustrated. The device is located between building bottom wall 2 as a construction member and building foundation 4 as another construction member. The lower surface of wall 2 is parallel to the upper surface of foundation 4. The vibration energy absorber device comprises first metal fixing member 8 fixed to the lower surface of wall 2, and second metal fixing member 10 fixed to the upper surface of foundation 4. Fixing members 8 and 10 are respectively fixed to wall 2 and foundation 4 by bolts (not shown).

Figure 3:
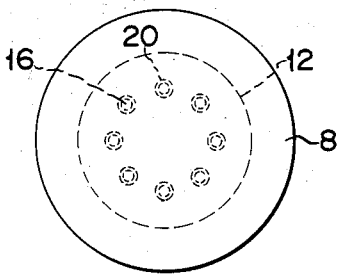
FIG. 3 is a plan view of the device in FIG. 1.
Figure 4:
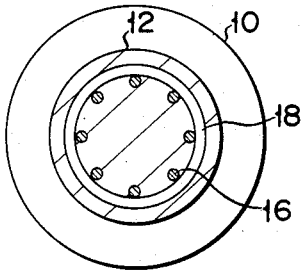
FIG. 4 is a cross-sectional view of the device in FIG. 1.

Elastoplastic member 12 is located between fixing members 8 and 10, and is made of a metal material selected from plastic metal materials such as lead, a lead alloy, and iron. In this embodiment, elastoplastic member 12 is made of lead. Since lead and the lead alloy are metal materials of high plasticity, they are suitable as elastoplastic materials for absorbing energy. Elastoplastic member 12 comprises a cylindrical member, as shown in FIGS. 3 and 4. The upper end of elastoplastic member 12 is braze-welded to fixing member 8, and the lower end of elastoplastic member 12 is braze-welded to fixing member 10.

Figure 2:
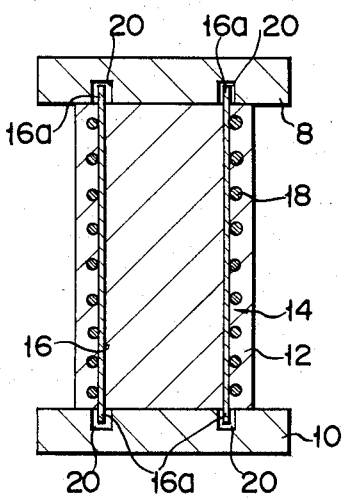
FIG. 2 is a longitudinal sectional view of the device in FIG. 1.

Reinforcement means 14 is embedded in elastoplastic member 12, as shown in FIG. 2. Reinforcement means 14 comprises a plurality of first members 16 and a plurality of second members 18. Each first member 16 is made of a metal material (e.g., an iron wire rod) of a higher tensile strength than that of the material of elastoplastic member 12. As is apparent from FIG. 2, each first member 16 axially extends through elastoplastic member 12. Extended end portions 16*a* of each first member 16 protrude into corresponding ends of elastoplastic member 12. Circular recesses 20 are formed in the surfaces of fixing members 8 and 10, which are coupled to elastoplastic member 12. Both ends of each first member 16 are respectively inserted in recesses 20. Each recess 20 has a diameter larger than that of first member 16. Annular gaps are formed between the outer surfaces of end portions 16a of first members 16 and the inner surfaces of recesses 20. First members 16 are arranged in the peripheral portion of elastoplastic member 12 at equal intervals in the circumferential direction of member 12, as shown in FIGS. 3 and 4. However, first members 16 need not be disposed at equal intervals.

Each second member 18 is a ring of the same metal material as that of first member 16. Ring-like second members 18 are disposed to surround first members 16, and are parallel to each other along the axial direction of elastoplastic member 12. Second members 18 are connected to first members 16 by weld or connecting wires. Since welding is performed in this manner, first and second members 16 and 18 can be easily positioned in elastoplastic member 12, when member 12 is cast.

The numbers and thicknesses of members 16 and 18 are determined so as not to substantially increase the rigidity of elastoplastic member 12, thereby preventing degradation of plasticity of elastoplastic member 12.

Figure 5:
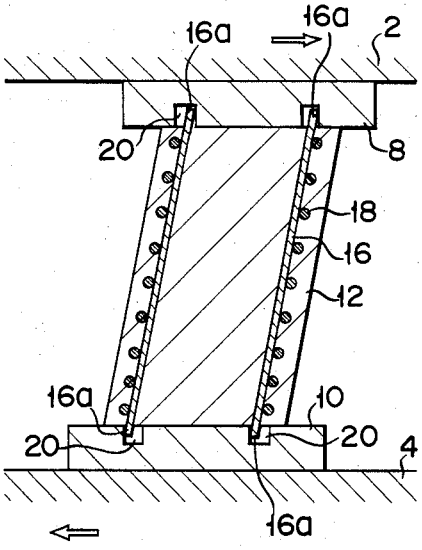
FIG. 5 is a sectional view showing an operating state of the device in FIG. 2.

According to the vibration energy absorber device of the first embodiment, when vibrations produced by an earthquake or the like are conducted to a building, the building cyclically repeats horizontal displacement relative to foundation 4. Upon cyclical displacement of the building, elastoplastic member 12 is plastically shear-deformed, as shown in FIG. 5. In this case, first members 16 are deformed along with member 12. Vibration energy causing the plastic deformation is absorbed by elastoplastic member 12, to decrease the amount of vibration energy conducted from foundation 4 to the building. In other words, part of the vibration energy conducted from foundation 4 to the building can be absorbed by elastoplastic member 12, and the load acting on the building can thus be reduced, thereby guaranteeing the safety of the building.

The vibration energy absorber device described above employs a mechanism for absorbing part of the vibration energy by periodic, plastic shear deformation of elastoplastic member 12. Since repeated plastic shear deformation occurs, both ends of elastoplastic member 12 of the conventional device tend to contract, and the axial central portion thereof is likely to expand radially. According to the vibration energy absorber device of the present invention, however, contraction and expansion of the diameter of elastoplastic member 12 can be effectively restricted by first and second members 16 and 18, embedded in elastoplastic member 12. In particular, contraction of both ends of elastoplastic member 12 can be prevented. The vibration energy absorption capacity of elastoplastic member 12 can be maintained for a long period of time, and early damage to elastoplastic member 12 at the end portions thereof can be prevented. Therefore, the service life of elastoplastic member 12 can be greatly prolonged.

Since the outer surface of elastoplastic member 12 is exposed, member 12 can be externally inspected or tested. As soon as an earthquake stops, elastoplastic member 12 can be inspected and, if necessary, replaced with ease.

In the first embodiment, second members 18 are welded to first members 16, but second members 18 are not coupled to each other. Thus, even if elastoplastic member 12 is deformed, as shown in FIG. 5, a radial force only acts on second members 18 due to deformation of elastoplastic member 12. However, a torsional force does not act on second members 18. Even if elastoplastic member 12 is deformed as shown in FIG. 5, second members 18 cannot be easily damaged, thus further improving durability of elastoplastic member 12.

In the first embodiment described above, end portions 16a of frame members 16 are respectively inserted in recesses 20 of fixing members 8 and 10. With this structure, if fixing member 8 should be disconnected from the upper end of elastoplastic member 12 and/or if fixing member 10 should be disconnected from the lower end of elastoplastic member 12, coupling between fixing members 8 and 10 and elastoplastic member 12 can be guaranteed. For example, assume the above-mentioned relationship between fixing member 8 and elastoplastic member 12. If the braze-welded portion between fixing member 8 and elastoplastic member 12 is removed, end portions 16a of first members 16 remain fitted in recesses 20 of fixing member 8. As a result, fixing member 8 is not disengaged from elastoplastic member 12. This coupling relationship is also applicable for that between fixing member 10 and elastoplastic member 12. Since the diameter of recess 20 is larger than that of first member 16, end portions 16a of first members 16 are not excessively bent upon shear deformation of member 12 and subsequent bending of first members 16. Therefore, end portions 16a of first members 16 are not overloaded, thus preventing damage thereto.

The present invention is not limited to the first embodiment. Other embodiments of the present invention will be described with reference to the accompanying drawings. The same reference numbers in the following embodiments denote the same parts as in the first embodiment and the previous modifications, and a detailed description thereof will be omitted.

Figure 6:
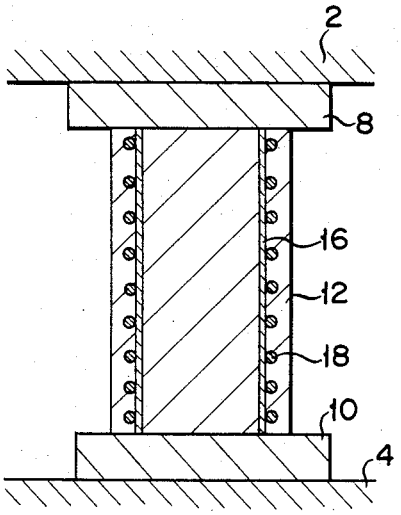
FIGS. 6 and 7 are respectively sectional views showing vibration energy absorber devices according to second and third embodiments of the present invention.

In the first embodiment, end portions 16a of first members 16 are respectively fitted in recesses 20 of fixing members 8 and 10. However, if sufficient strength, achieved by adhesion between the fixing members and member 12 is guaranteed, the length of each first member 16 can be equal to that of elastoplastic member 12, as in a second embodiment shown in FIG. 6. In the embodiment of FIG. 6, recesses 20 need not be formed in fixing members 8 and 10.

Figure 7:
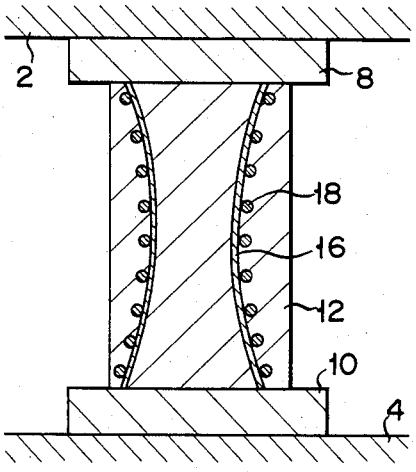

As shown in a third embodiment in FIG. 7, axial central portions of first members 16 may be arcuated inward in elastoplastic member 12. In this embodiment, second members 18, at the axial central portion of elastoplastic member 12, have the smallest diameter. The diameter of second members 18 gradually increases as they move away from the center of elastoplastic member 12, along the axial direction thereof.

A vibration energy absorber device according to a fourth embodiment of the present invention is illustrated in FIGS. 8 to 11. In the device of this embodiment, second members 18 are omitted. The distinctive difference between the fourth embodiment and the previous embodiments lies in the coupling structure between fixing members and the ends of elastoplastic member 12. More specifically, in the fourth embodiment, Elastoplastic member 12 includes large-diameter portions 12a at both ends thereof, Large-diameter portions 12a have a diameter larger than the axial center of elastoplastic member 12. Each large-diameter portion 12a has a stepped surface 22 extending radially from the outer surface of elastoplastic member 12 and tapered surface 24, the diameter of which gradually increases up to the end face of large-diameter portion 12*a*. Through hole 26 is formed in fixing member 8. Large-diameter portion 12*a* of elastoplastic member 12 and the portion thereof near stepped surface 22 are fitted in hole 26. The inner shape of hole 26 is the same as the inner shape of a mold for casting large-diameter portion 12*a*. As is apparent from FIG. 8, hole 26 is also formed in fixing member 10. Large-diameter portions 12*a* of elastoplastic member 12 are respectively fixed to fixing members 8 and 10 by simple fitting or braze-welding.

In the device of the fourth embodiment, a shear force acts on portions of elastoplastic member 12 near fixing members 8 and 10, to contract them. However, contraction deformation of that portion can be prevented by first members 16. Expansion deformation near the axial central portion of elastoplastic member 12 can also be prevented by first members 16.

In the fourth embodiment, both ends (i.e., large-diameter portions 12*a*) of elastoplastic member 12 are fitted in the corresponding fixing members. The contact surface between the elastoplastic member 12 and fixing members 8 and 10 can be increased, in comparison compared to that of the previous embodiments, thereby guaranteeing secure coupling therebetween.

In the fourth embodiment, when plastic shear deformation cyclically occurs in elastoplastic member 12, stress is concentrated at portions thereof near fixing members 8 and 10, due to contact of said portions with the edges of holes 26 in fixing members 8 and 10. Elastoplastic member 12 is likely to be damaged at these stressed portions. However, in the fourth embodiment, first members 16 extend along the entire length of elastoplastic member 12, and the allowable shear stress of the stressed portions of elastoplastic member 12 can thus be increased. Therefore, damage to elastoplastic member 12 at these stressed portions can be effectively prevented.

Figure 11:
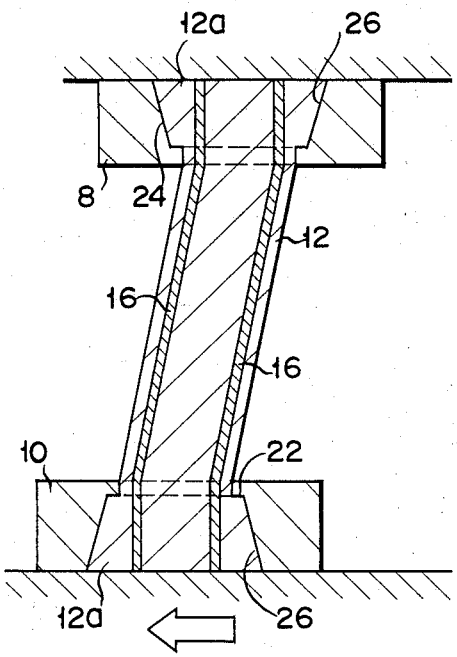
FIG. 11 is a sectional view showing an operating state of the device in FIG. 8.

As shown in FIG. 11, if elastoplastic member 12 is shear-deformed and restored to its original state, a force acts on both end portions (i.e., large-diameter portions 12*a*) of elastoplastic member 12, to remove large-diameter portions 12*a* from the corresponding fixing members. However, stepped surfaces 22 are formed on large-diameter portions 12*a* and engage with the corresponding stepped surfaces of holes 26 in fixing members 8 and 10. Therefore, stepped surfaces 22 prevent elastoplastic member 12 from being removed from fixing members 8 and 10.

Figure 12:
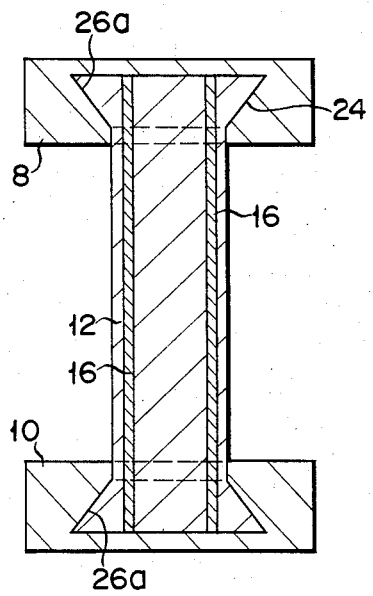
FIGS. 12 to 19 are respectively sectional views entirely or partially showing vibration energy absorber devices according to fifth to twelfth embodiments of the present invention.

FIGS. 12 to 19 show fifth to twelfth embodiments of the present invention, respectively. In the embodiment of FIG. 12, blind holes, i.e., recesses 26*a* are respectively formed in fixing members 8 and 10 in place of through holes 26. Large-diameter portions 12*a* of elastoplastic member 12 are respectively fitted in recesses 26*a*.

Figure 13:
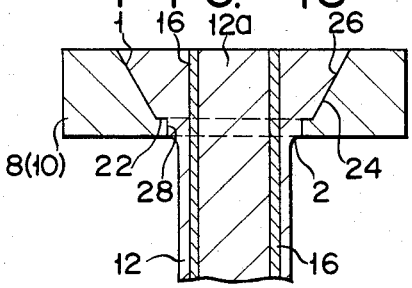
Figure 14:
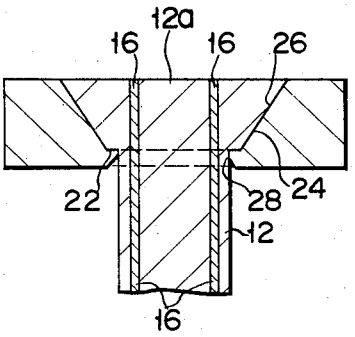

In the embodiment of FIG. 13, rounded corners 28 are formed in the above-mentioned stressed portions, i.e., portions of elastoplastic member 12 near the fixing members. According to this embodiment, stress concentration on rounded corners 28 can be decreased. In the embodiment of FIG. 14, rounded portions 28 are formed in the fixing members, at the edges of holes 26. In this case, the stress concentrated on those portions of elastoplastic member 12 can be decreased, as in the embodiment of FIG. 13.

Figure 8:
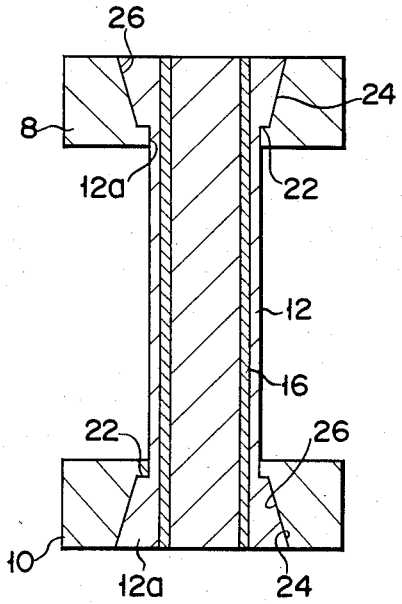
FIG. 8 is a sectional view showing a vibration energy absorber device according to a fourth embodiment of the present invention.
Figure 9:
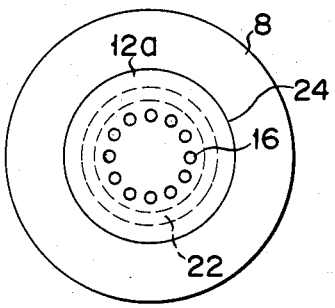
FIG. 9 is a plan view of the device in FIG. 8.
Figure 10:
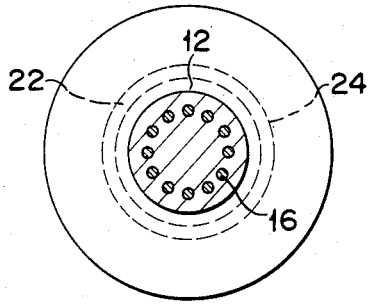
FIG. 10 is a cross-sectional view of the device in FIG. 8.
Figure 15:
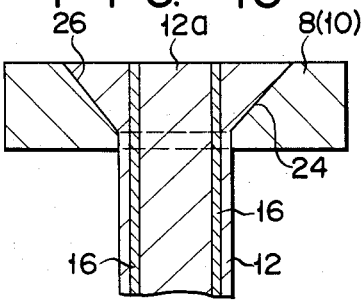
Figure 16:
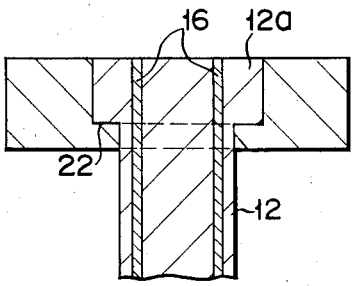

In the embodiment of FIG. 15, unlike in the embodiment of FIG. 8, stepped surface 22, on large-diameter portion 12*a* in elastoplastic member 12, is omitted. In the embodiment of FIG. 15, large-diameter portion 12*a* is prevented from being removed from the corresponding fixing member by tapered surface 24. In the embodiment of FIG. 16, tapered surface 24 on large-diameter portion 12*a* is omitted. Large-diameter portion 12*a* is prevented from being removed from the corresponding fixing member by stepped surface 22. In this case, stepped surface 22 is preferably larger than those of the previous embodiments.

Figure 17:
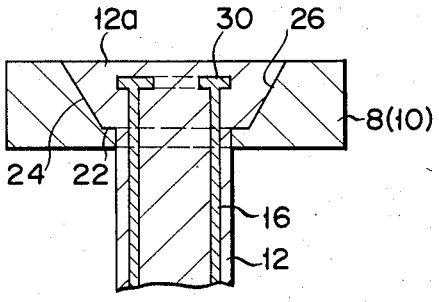

In the embodiment of FIG. 17, each first member 16 is slightly shorter than elastoplastic member 12. At the same time, both ends of first members 16 are respectively coupled to ring members 30. According to this embodiment, if elastoplastic member 12 is cast while first members 16 are embedded therein, first members 16 can be easily positioned in elastoplastic member 12.

Figure 18:
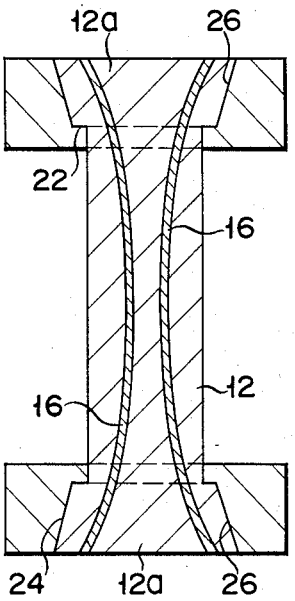
Figure 19:
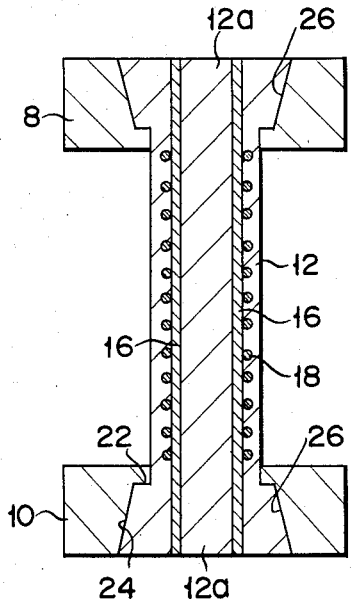
Figure 20:
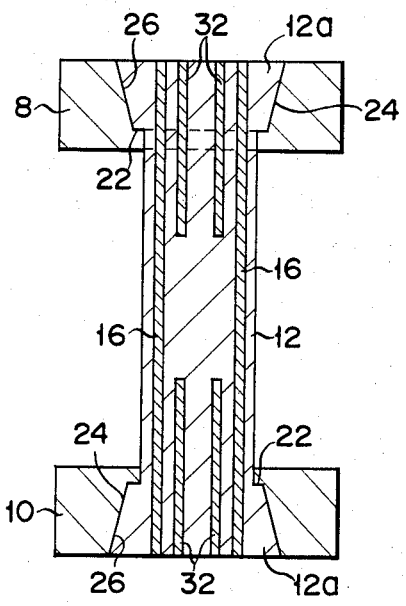
FIG. 20 is a longitudinal sectional view of a vibration energy absorber device according to a thirteenth embodiment of the present invention.
Figure 21:
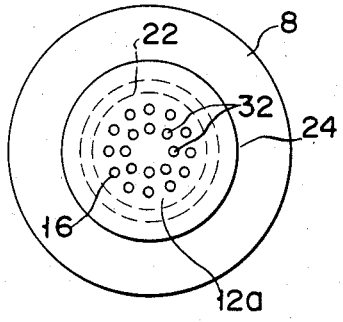
FIG. 21 is a plan view of the device in FIG. 20.
Figure 22:
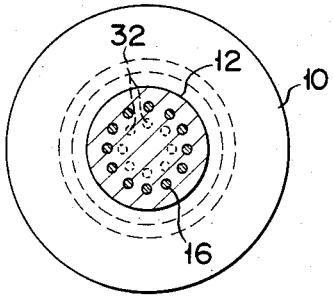
FIG. 22 is a cross-sectional view of the device in FIG. 20.

The embodiment in FIG. 18 exemplifies arcuated first members 16, as in the embodiment of FIG. 7. The embodiment in FIG. 19 illustrates a case wherein second members 18 are used in the embodiment of FIG. 8.

Referring to FIGS. 20 to 23, a vibration energy absorber device according to a thirteenth embodiment of the present invention is illustrated. In this embodiment, a plurality of third members 32 are embedded in elastoplastic member 12, in addition to first members 16. Frame members 32 are made of metal wire rods, in the same manner as first members 16, and are disposed inside first members 16 at equal intervals in the circumferential direction of elastoplastic member 12. Third members 32 are embedded at both end portions of elastoplastic member 12, as can be seen from FIG. 20. More specifically, third members 32 extend from end faces of large-diameter portions 12*a* of elastoplastic member 12, through portions 12*a*, and are directed toward the center of elastoplastic member 12. The length of each third member 32 is twice or more that of the fixing members.

Figure 23:
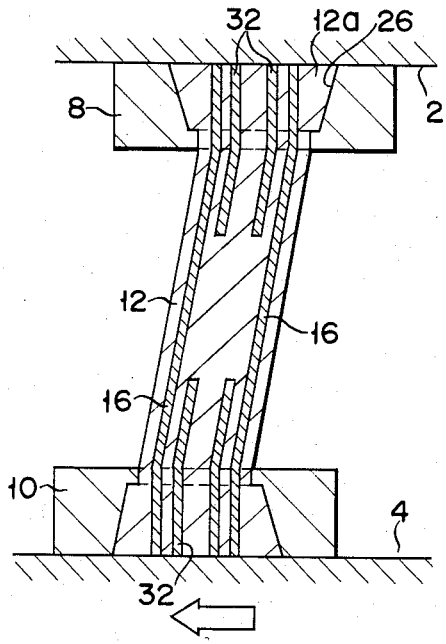
FIG. 23 is a sectional view showing an operating state of the device in FIG. 20.

According to the thirteenth embodiment, if elastoplastic member 12 is plastically shear-deformed as shown in FIG. 23, the largest strain produces on the end portions of elastoplastic member 12. However, since third members 32 are embedded in the end portions, in addition to first members 16, the allowable shear stress at the end portions can be increased. Cracks or damage to the end portions of elastoplastic member 12 can thus be effectively prevented.

Figure 24:
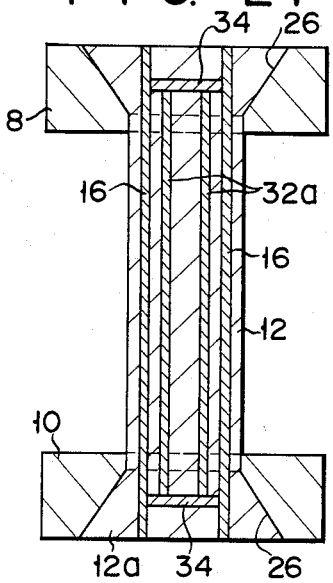
FIGS. 24 to 27 are sectional views showing vibration energy absorber devices according to fourteenth to seventeenth embodiments of the present invention, respectively.
Figure 25:
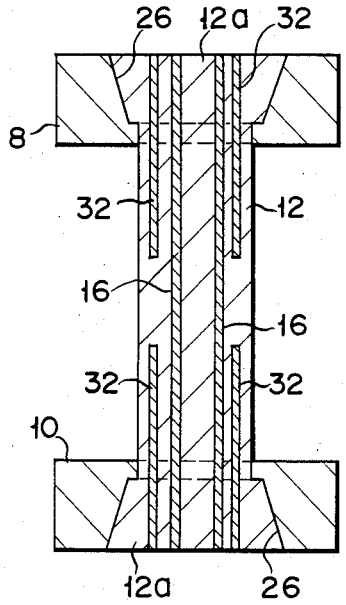
Figure 26:
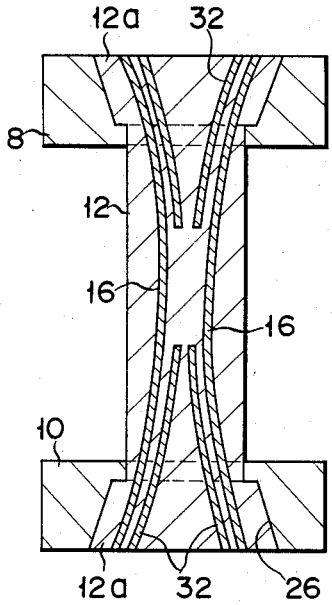
Figure 27:
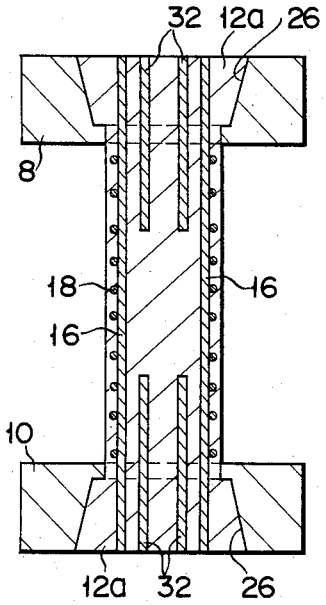

FIGS. 24 to 27 show respectively fourteenth to seventeenth embodiments of the present invention. In the embodiment of FIG. 24, a plurality of third members 32*a*, extending between large-diameter portions 12*a*, are embedded in elastoplastic member 12. At the same time, both ends of first and third members 16 and 32*a* are coupled to discs 34, having the same function as that of ring members 30 in FIG. 17. In the embodiment of FIG. 25, third members 32 are disposed outside first members 16, at equal intervals in the circumferential direction of elastoplastic member 12. In the embodiment of FIG. 26, first and third members 16 and 32 are arcuated in the same manner as in the embodiments of FIGS. 7 and 18. The embodiment of FIG. 27 illustrates a case wherein second members 18 are used in the embodiment of FIG. 20.

Figure 28:
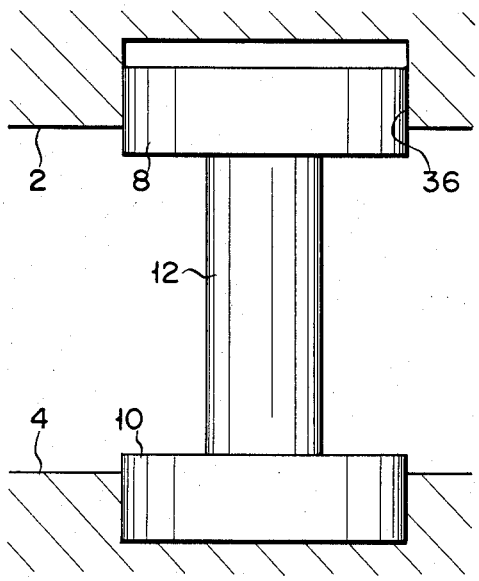
FIG. 28 is a front view of a vibration energy absorber device according to an eighteenth embodiment of the present invention.

FIG. 28 shows an eighteenth embodiment of the present invention. In this embodiment, first fixing member 8 is mounted on building bottom wall 2 and is vertically movable. Recess 36 is formed in the lower surface of bottom wall 2, and fixing member 8 is slidably fitted in recess 36.

In the embodiment of FIG. 28, even if the distance between the building and foundation 4 varies due to vertical vibrations produced by an earthquake or the like, fixing member 8 can slide within recess 36 in wall 2. Therefore if vertical vibrations take place, axial tension and compression do not act on elastoplastic member 12. As a result, the device is not adversely affected by vertical vibrations and thus the energy absorption capacity of elastoplastic member 12 can be maintained.

The present invention is not limited to the particular embodiments described above. In each embodiment, elastoplastic member 12 is a cylindrical member but can be a columnar member. A cover may be overspread on the outer surface of elastoplastic member 12 to prevent the outer surface from corrosion without interfering with inspection of elastoplastic member 12. For the same purpose, an anti-corrosion coating layer may be formed on the outer surface of elastoplastic member 12.

As is omitted in the embodiments described above, the weight of the building itself is not supported by the vibration energy absorber devices of the present invention, but by an appropriate supporting means disposed between building bottom wall 2 and foundation 4. A required number of vibration energy absorber devices can be disposed between wall 2 and foundation 4.

What is claimed is:

1. A vibration energy absorber device located between two construction members, having oppsite surfaces spaced apart from each other, for absorbing vibration energy causing a relative displacement of the construction members along a direction parallel thereto, comprising:

first and second fixing members, respectively mounted on the construction members such that at least a displacement of each fixing member relative to the corresponding construction member along the parallel direction is prevented;

an elastoplastic member which is located between the first and second fixing members, the elastoplastic member having two ends which are respectively coupled to the first and second fixing members and being subjected to plastic shear deformation; and reinforcing means embedded in the elastoplastic member so as to allow plastic shear deformation of the elastoplaetic member, the reinforcing means including a plurality of first reinforcing members made of a material having a higher mechanical strength than that of the elastoplastic member, and the first reinforcing members extending from one end to the other end of the elastoplastic member, and being distributed along a peripheral portion of the elastoplastic member.

2. A device according to claim 1, wherein the first and second fixing members are braze-welded to the elastoplastic member.

3. A device according to claim 2, wherein both ends of the first reinforcing members extend beyond both ends of the elastoplastic member, and recesses are formed in the surfaces of the first and second fixing members, which contact the elastoplastic member, to receive end portions of the first reinforcing members.

4. A device according to claim 3, wherein the recesses have a diameter such that a predetermined annular gap is formed at outer periphery of the end portions of the first reinforcing members when the end portions are respectively inserted in the recesses.

5. A device according to claim 1, wherein a plurality of second reinforcing members, of a material having a higher mechanical strength than that of the elastoplastic member, are embedded in the elastoplastic member and surround the set of first reinforcing members so as to constitute a ring shape at predetermined intervals along the axial direction of the elastoplastic member.

6. A device according to claim 1, wherein both end portions of the elastoplastic member constitute large-diameter portions which are respectively fitted in holes formed in the first and second fixing members.

7. A device according to claim 6, wherein large-diameter portions of the elastoplastic member respectively have portions tapered toward end faces thereof.

8. A device according to claim 7, wherein stepped surfaces are respectively formed at boundaries between an axial central portion of said elastoplastic member and said tapered portions, the stepped surfaces being in contact with stops formed on surfaces defining the holes of the first and second fixing members, when large-diameter portions of the elastoplastic members are respectively fitted in the first and second fixing members.

9. A device according to claim 6, wherein a plurality of third reinforcing members are embedded in the elastoplastic member and extend from large-diameter portions of the elastoplastic member toward the axial central portion thereof, the third reinforcing members being distributed in the peripheral portion of the elastoplastic member.

10. A device according to claim 1, wherein the elastoplastic member is made of one material selected from the group consisting of lead, a lead alloy, and iron.

11. A device according to claim 1, wherein said elastoplastic member comprises a solid member and wherein said first reinforcing member comprises a rod member.

* * * * *

UNITED STATES PATENT AND TRADEMARK OFFICE

CERTIFICATE OF CORRECTION

PATENT NO. : 4,731,966

DATED : Mar. 22, 1988

INVENTOR(S) : Takafumi FUJITA, et al.

It is certified that error appears in the above-identified patent and that said Letters Patent is hereby corrected as shown below: On the title page The third item listed under Foreign Application Priority Data should read as follows:

-- Jun. 19, 1985 [JP] Japan ..... 60-133434 --

Signed and Sealed this

Nineteenth Day of July, 1988

*Attest:*

DONALD J. QUIGG

*Attesting Officer*

*Commissioner of Patents and Trademarks*